US005122032A

United States Patent [19]

Shields et al.

[11] Patent Number: 5,122,032

[45] Date of Patent: Jun. 16, 1992

[54] DISPOSABLE PUMP ASSEMBLY

[75] Inventors: Gerald N. Shields, Lake Forest; Brian Kent, Knollwood, both of Ill.

[73] Assignee: Graymills Corporation, Chicago, Ill.

[21] Appl. No.: 725,921

[22] Filed: Jul. 15, 1991

Related U.S. Application Data

[63] Continuation of Ser. No. 301,953, Jan. 26, 1989, abandoned.

[51] Int. Cl.[5] ..... F01D 25/24

[52] U.S. Cl. ..... 415/214.1; 415/200; 415/215.1; 415/216.1; 415/915; 416/204 R

[58] Field of Search ..... 415/206, 213.1, 216.1, 415/229, 200, 915, 912, 214.1, 215.1; 416/204 R, 206, 207, 223 B; 264/545, 512; 403/361, 383; 417/360, 423.15, 423.11, 423.14, 424.01

[56] References Cited

U.S. PATENT DOCUMENTS

| | | | |
|---|---|---|---|
| 2,464,936 | 3/1949 | McConaghy | 417/423.15 |
| 2,625,720 | 1/1953 | Ross | 415/213.1 |
| 2,868,132 | 1/1959 | Rittershofer | 417/234 |
| 2,997,957 | 8/1961 | Hall | 415/200 |
| 3,319,939 | 5/1967 | Rogenski | 416/204 |
| 3,335,668 | 8/1967 | Thon | 415/200 |
| 3,604,819 | 9/1971 | Krahe | 415/216.1 |
| 3,707,335 | 12/1972 | Barnard | 415/200 |
| 3,779,668 | 12/1973 | Ekey | 415/216.1 |
| 3,814,551 | 6/1974 | Weis | 417/423.11 |
| 3,837,767 | 9/1974 | Aller | 417/423.14 |
| 3,936,221 | 2/1976 | Lobanoff | 415/200 |
| 3,947,152 | 3/1976 | Ross et al. | 417/360 |
| 3,958,894 | 5/1976 | Rowley et al. | 415/200 |
| 3,961,382 | 6/1976 | Peterson, Jr. | 417/423.14 |
| 4,049,364 | 9/1977 | Ross et al. | 417/360 |
| 4,185,937 | 1/1980 | Anderson | 403/383 |
| 4,211,519 | 7/1980 | Hogan | 417/360 |
| 4,265,839 | 5/1981 | Baus | 417/360 |
| 4,305,902 | 12/1981 | Uhlig | 264/540 |
| 4,403,923 | 9/1983 | Korchin | 417/360 |
| 4,557,672 | 12/1985 | Levine | 417/424.1 |
| 4,786,239 | 11/1988 | Eberhardt | 417/360 |
| 4,832,573 | 5/1989 | Dorski | 415/216.1 |

FOREIGN PATENT DOCUMENTS

| | | | |
|---|---|---|---|
| 131326 | 1/1985 | European Pat. Off. | 415/216.1 |
| 7699093 | 10/1980 | U.S.S.R. | 415/206 |
| 1148848 | 4/1969 | United Kingdom | 415/206 |

*Primary Examiner*—John T. Kwon

*Attorney, Agent, or Firm*—Wood, Phillips, VanSanten, Hoffman & Ertel

[57] ABSTRACT

A disposable pump assembly adapted to be driven by a motor through an elongated shaft. The disposable pump assembly includes a pump body having a volute portion and an elongated riser portion extending upwardly from the volute portion. The riser portion is integrally joined to the volute portion by a neck defining a restricted opening leading from the riser portion to the volute portion. The elongated shaft is adapted to be inserted into the riser portion, through the restricted and into the volute portion of the pump body. The disposable pump assembly also includes a shaft-receiving impeller disposed in the volute portion of the pump body for driven movement by the motor. The impeller and the elongated shaft each have correspondingly shaped portions for interconnecting and driving the impeller upon insertion of the shaft through the riser portion and into the volute portion of the pump body. The volute portion of the pump body has an inlet opening and an outlet opening from which an outlet tube extends upwardly in spaced parallel relation to the riser portion. With this arrangement, the disposable pump assembly can be formed of a plastic material by a thermoforming or blow molding process in a manner accommodating rapid interconnection of a supply tube and the motor thereto.

25 Claims, 3 Drawing Sheets

DISPOSABLE PUMP ASSEMBLY

This application is a continuation, of application Ser. No. 301,953, filed Jan. 26, 1989, abandoned.

FIELD OF THE INVENTION

The present invention generally relates to pumps that are adapted to be driven by a motor through an elongated shaft and, more particularly, to a disposable pump assembly formed of a plastic material at least in part by a thermoforming and blow molding process.

BACKGROUND OF THE INVENTION

Generally, it is recognized in the flexographic printing industry that printing runs are not of particularly lengthy duration. Typically, such runs usually last anywhere from a fraction of an hour to on the order of six hours. For this purpose, it is important for ink circulating systems to be capable of meeting the unique requirements of the industry.

As will be appreciated, ink circulating systems have usually included a tank containing ink of a selected color. Then, an immersion pump supporting a motor on a mounting plate is placed in the tank and a supply tube is connected to an outlet of the pump. In this manner, the pump is able to circulate ink to maintain a constant level and flow at the printing station.

In addition, ink circulating systems have other requirements including the ability to keep pigments, binders, solvents and additives evenly blended in suspension. This can be accomplished through constant conditioning and circulation which helps maintain uniform color and viscosity. Still further, since the tanks which hold the ink are conventionally covered by lids, the resulting closed system is practical for substantially retarding evaporation.

Unfortunately, cleanup and changeover of the pump has always been recognized as time consuming. It requires running a solvent through the pump for cleaning and entirely wiping off the external portions of the pump which have been submerged in ink; operations which normally take on the order of 20 to 30 minutes which is highly excessive in comparison with the duration of the typical run, e.g., a fraction of an hour to approximately six hours. However, due to the frequent changes in ink color, it is essential to undertake this cleanup process.

As will be appreciated, not only is the cleanup process time consuming, but it is also a dangerous undertaking. It is known, for instance, that the solvents used for this purpose can pose an environmental hazard as well as present the potential for explosions. For these reasons, it would be highly desirable to provide a disposable pump for such applications.

The present invention is directed to overcoming the foregoing problems and accomplishing the stated objects.

SUMMARY OF THE INVENTION

Accordingly, the present invention is directed to a disposable pump assembly adapted to be driven by a motor through elongated shaft means. The pump assembly includes a pump body with a volute portion and an elongated riser portion extending upwardly from the volute portion. The riser portion is integrally joined to the volute portion by a neck defining a restricted opening leading from the riser portion to the volute portion.

The elongated shaft means is adapted to be inserted into the riser portion, through the restricted opening and into the volute portion of the pump body. The pump assembly also includes a shaft-receiving impeller disposed in the volute portion of the pump body for driven movement by the motor. The impeller and the elongated shaft means each have corresponding rapid interconnect and drive means adapted for mating engagement upon insertion of the elongated shaft means through the riser portion and into the volute portion of the pump body. The impeller is adapted for driven movement upon mating engagement of the rapid interconnect and drive means. With this arrangement, the volute portion of the pump body has an inlet opening and an outlet opening with the pump body having an outlet tube extending upwardly from the outlet opening in spaced parallel relation to the riser portion.

In the preferred embodiment, the riser portion and outlet tube each have an upper end remote from the volute portion. The upper end of the riser portion and the motor each have corresponding rapid interconnect means for releasably securing the motor to the riser portion whereas the upper end of the outlet tube includes means for releasably coupling a supply tube thereto. In order to render the pump a disposable assembly, the volute portion, riser portion, outlet tube and impeller are all formed of a plastic material.

Preferably, the volute portion and the riser portion are formed so as to be shaped in a generally cylindrical fashion. The restricted opening defining the neck between the volute portion and the riser portion also is advantageously formed in a generally cylindrical shape. Further, the neck preferably has a diameter substantially the same as the diameter of the elongated shaft means to define a bearing surface therefor.

More specifically, the bearing surface defined by the neck forms a partial seal between the volute portion and the riser portion. The partial seal is adapted to limit penetration of a liquid (such as ink) being pumped from a container into the riser portion. However, the riser portion includes at least one opening disposed above the neck for draining any liquid penetrating the partial seal.

In an exemplary embodiment, the inlet opening in the volute portion of the pump body is disposed in a bottom wall thereof. It should be noted that the inlet opening is generally coaxial with the volute portion, riser portion and neck therebetween. Further, the outlet opening in the volute portion of the pump body is disposed radially outwardly of the inlet opening in a side wall thereof.

Additional details include the impeller being generally cup-shaped and having a plurality of blades extending radially therein. The rapid interconnect and drive means then comprises, at least in part, a centrally disposed axial shaft-receiving portion of the impeller. More specifically, the shaft-receiving portion and the elongated shaft means each have corresponding non-circular cross-sections for driven movement of the impeller by the motor.

Preferably, the shaft-receiving portion of the impeller includes first and second axially spaced hexagonally shaped regions with the first hexagonally shaped region being dimensioned larger than the second hexagonally shaped region. With this arrangement, the elongated shaft means will be formed so as to include first and second axially spaced hexagonally shaped regions sized and shaped for insertion into the shaft-receiving portion of the impeller.

In the preferred embodiment, the shaft-receiving portion of the impeller includes a socket-defining projection which is integral with and extends from the bottom of the impeller. The first hexagonally shaped region of the shaft-receiving portion is then advantageously disposed adjacent the blades of the impeller and the second hexagonally shaped region is disposed in the projection. Moreover, the shaft-receiving portion of the impeller is formed such that the socket-defining projection includes an axially disposed opening adapted to receive a detent on the end of the elongated shaft means.

Still additional details include the rapid interconnect means of the riser portion of the pump body being operatively associated with the upper end of the riser portion. The releasable coupling means of the outlet tube is also advantageously operatively associated with the upper end of the outlet tube. Still further, the rapid interconnect means and the releasable coupling means are each preferably disposed in a common plane at generally the same distance above the volute portion of the pump body.

Preferably, at least one support rib extends between the riser portion and the outlet tube of the pump body. The support rib is then positioned generally parallel to and spaced above the volute portion of the pump body in proximity to the upper ends of the riser portion and the outlet tube. With this arrangement, the support rib is formed of a plastic material so as to be integral with the riser portion and the outlet tube of the pump body.

As for the rapid interconnect means of the riser portion of the pump body, it may advantageously be defined at least in part by a collar formed in integral fashion on the upper end thereof. Then, the disposable pump assembly contemplates a motor-supporting mounting block associated with the motor and adapted to fit over the collar of the riser portion wherein the mounting block further includes at least one clamp assembly adapted to cooperate with the collar. Still additionally, the releasable securing means of the outlet tube preferably includes an externally threaded upper end thereof adapted to receive an internally threaded coupling of a liquid supply tube.

With the present invention, it will be appreciated that a disposable pump assembly adapted to be driven by a motor through an elongated shaft has been provided. The pump assembly, which is constructed of a suitable plastic material so as to withstand inks and solvents, is advantageously formed at least in part by a thermoforming process or, alternatively, a blow molding process so as to comprise an entirely self-contained unit. As a result, a motor and shaft can quickly be removed from one disposable pump assembly and installed in another in a manner significantly minimizing changeover time.

Other objects, advantages and features of the present invention will become apparent from a consideration of the following specification taken in conjunction with the accompanying drawings

DETAILED DESCRIPTION OF THE PREFERRED EMBODIMENT

Figure 1:
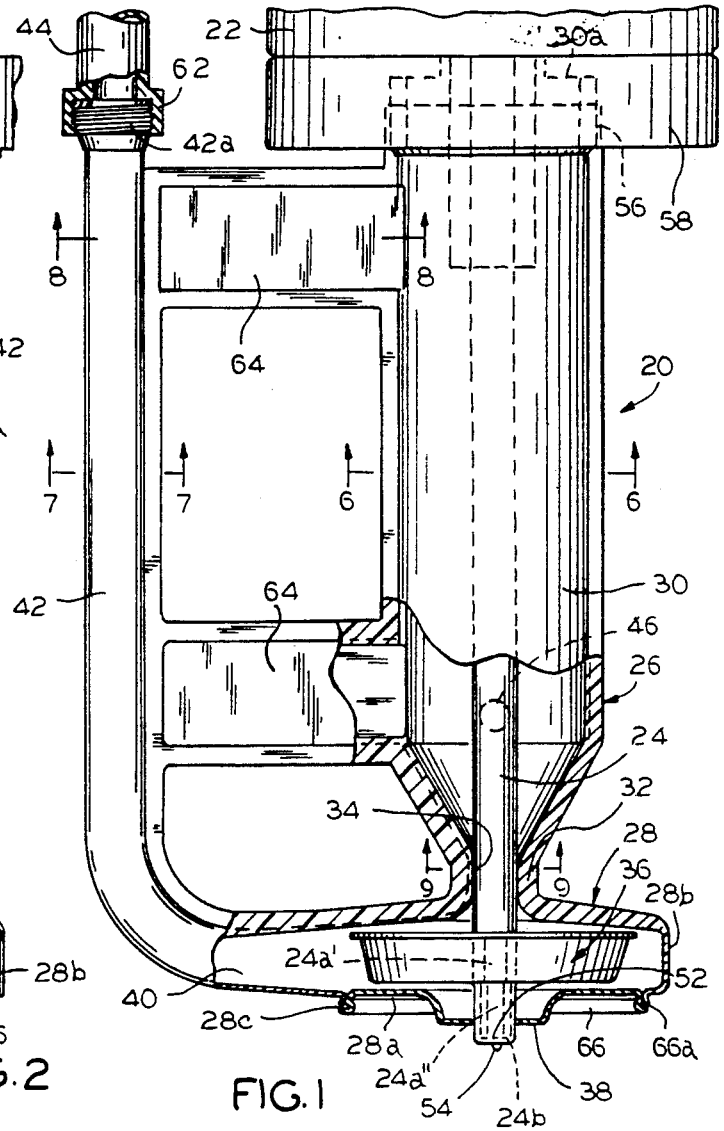
FIG. 1 is a side elevational view of a disposable pump assembly in accordance with the present invention.

Referring to the drawings, and first to FIG. 1, the reference numeral 20 designates generally a disposable pump assembly adapted to be driven by a motor 22 through an elongated shaft 24. The disposable pump assembly 20 includes a pump body 26 including a volute portion 28 and an elongated riser portion 30 extending upwardly from the volute portion 28. The riser portion 30 is integrally joined to the volute portion 28 by a neck 32 defining a restricted opening 34 leading from the riser portion 30 to the volute portion 28. The elongated shaft 24 is adapted to be inserted into the riser portion 30, through the restricted opening 34 and into the volute portion 28 of the pump body 26. The disposable pump assembly 20 also includes a shaft-receiving impeller 36 (see, also, FIGS. 10 and 11) disposed in the volute portion 28 of the pump body 26 for driven movement by the motor 22. The impeller 36 and the elongated shaft 24 each have corresponding rapid interconnect and drive means adapted for mating engagement upon insertion of the elongated shaft 24 through the riser portion 30 and into the volute portion 28 of the pump body 26. The impeller 36 is adapted for driven movement upon mating engagement of the rapid interconnect and drive means. With this arrangement, the volute portion 28 of the pump body 26 has an inlet opening 38 and an outlet opening 40 and an outlet tube 42 extends upwardly from the outlet opening 40 in spaced parallel relation to the riser portion 30.

Figure 2:
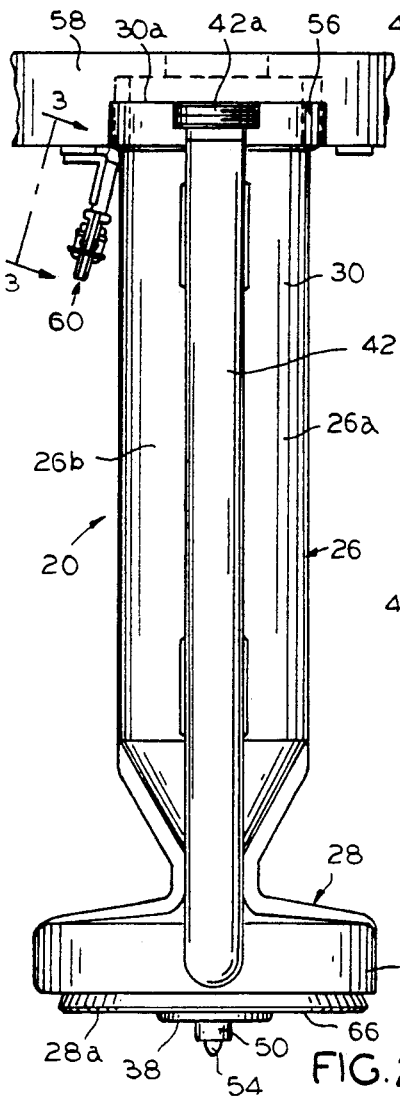
FIG. 2 is a rear elevational view of the disposable pump assembly illustrated in FIG. 1.

As will be seen from FIGS. 1 and 2, the riser portion 30 and the outlet tube 42 each have an upper end **30*a* and 42*a*, respectively, which is positioned so as to be remote from the volute portion 28. The upper end 30*a* of the riser portion 30 and the motor 22 each have corresponding rapid interconnect means for releasably securing the motor 22 to the riser portion 30 and, likewise, the upper end 42*a* of the outlet tube 40 includes means for releasably coupling a supply tube 44 thereto. By forming the components in this manner, a volute portion 28, riser portion 30, outlet tube 42, and impeller 36** may all advantageously be formed of a plastic material at least in part by a thermoforming or blow molding process as an entirely self-contained unit.

Figure 4:
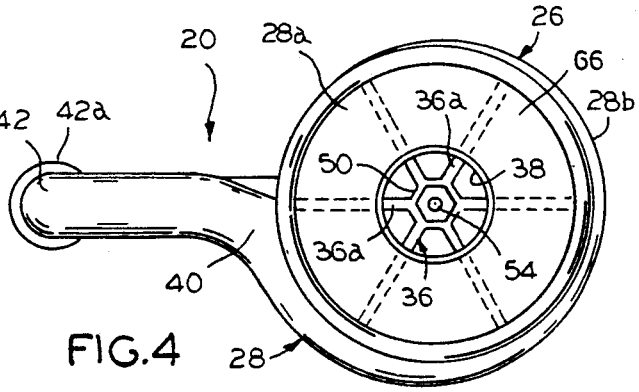
FIG. 4 is a bottom plan view of the disposable pump assembly illustrated in FIG. 1.
Figure 5:
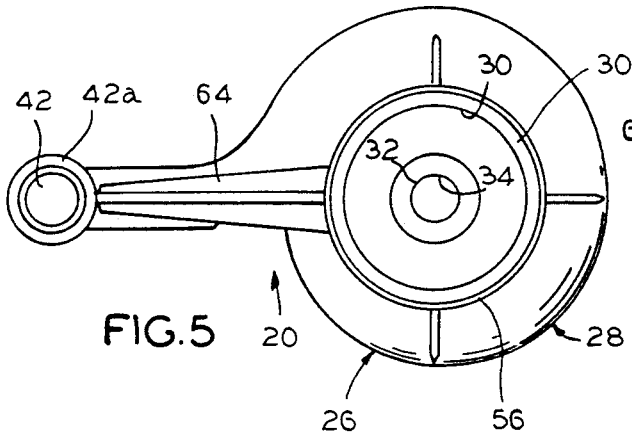
FIG. 5 is a top plan view of the disposable pump assembly illustrated in FIG. 1.
Figure 6:
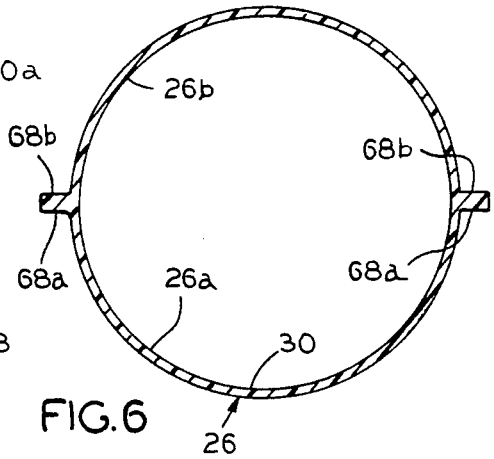
FIG. 6 is a cross-sectional view taken on the line 6—6 of FIG. 1.
Figure 9:
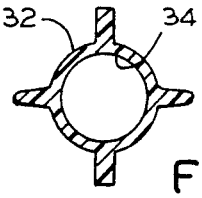
FIG. 9 is a cross-sectional view taken on the line 9—9 of FIG. 1.

By referring to FIGS. 4 and 6, it will be appreciated that the volute portion 28 and the riser portion 30 are shaped generally cylindrical. It will also be seen from FIG. 9 that the restricted opening 34 defining the neck 32 between the volute portion 28 and the riser portion 30 also is shaped generally cylindrical. As best illustrated in FIG. 1, the neck 32 has a diameter substantially the same as the diameter of the elongated shaft 24 to define a bearing surface as at 34 therefor.

With this construction, the bearing surface as at 34 defined by the neck 32 forms a partial seal between the volute portion 28 and the riser portion 30. The partial seal is adapted to limit penetration of a liquid (such as ink) being pumped from a container (not shown) into the riser portion 30. However, as shown, the riser portion 30 also preferably includes at least one, and suitably a pair, of openings 46 disposed above the neck 32 for draining the liquid penetrating the partial seal.

Referring specifically to FIGS. 1 and 4, the inlet opening 38 in the volute portion 28 of the pump body 26 is disposed in a bottom wall 28*a* thereof. The inlet opening 38 is generally coaxial with the volute portion 28, riser portion 30 and neck 32 therebetween. Moreover, the outlet opening 40 in the volute portion 28 of the pump body 26 (see FIG. 1) is disposed radially outwardly of the inlet opening 38 so as to be disposed in a sidewall 28*b* thereof.

Figure 10:
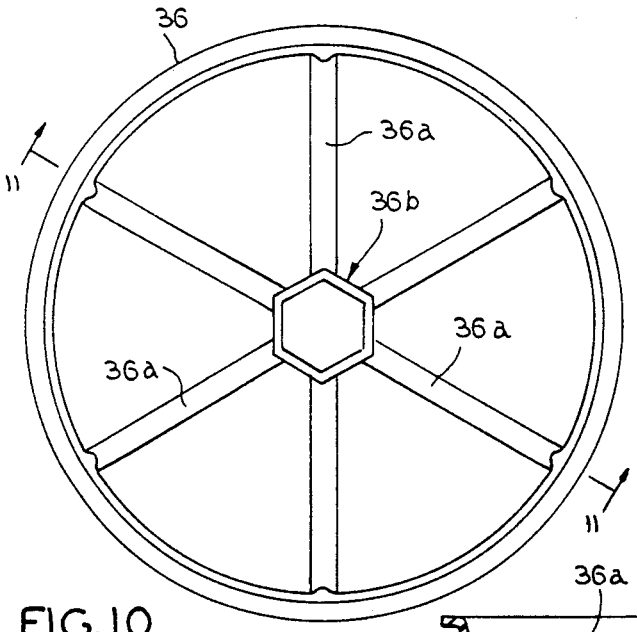
FIG. 10 is a top plan view of an impeller for the disposable pump assembly of FIG. 1.
Figure 7:
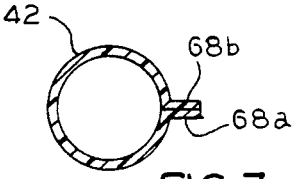
FIG. 7 is a cross-sectional view taken on the line 7—7 of FIG. 1.
Figure 11:
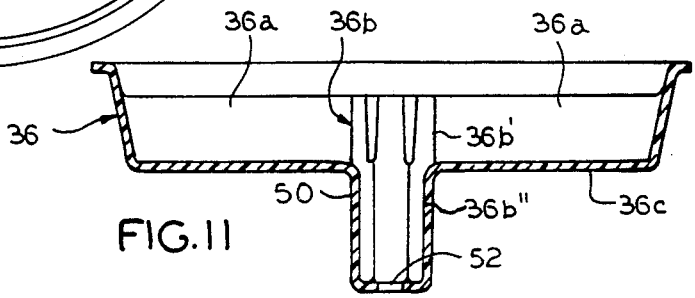
FIG. 11 is a cross-sectional view taken on the line 11—11 of FIG. 10.

Referring to FIGS. 10 and 11, the impeller 36 is generally cup-shaped and has a plurality of blades 36*a* extending radially therein. The rapid interconnect and drive means mentioned previously comprises at least in part a centrally disposed axial shaft-receiving portion 36*b* of the impeller 36. The shaft-receiving portion 36*b* and the elongated shaft 24 have corresponding non-circular cross-sections for driven movement of the impeller 36 by the motor 22, i.e., the non-circular cross-sections are, preferably, defined by first and second axially spaced hexagonally shaped regions 36*b*′ and 36*b*″. The first hexagonally shaped region 36*b*′ is then advantageously dimensioned larger than the second hexagonally shaped region 36*b*″. As will be appreciated from FIG. 1, the elongated shaft 24 then includes correspondingly sized first and second axially spaced hexagonally shaped regions 24*a*′ and 24*a*″ for insertion into the shaft-receiving opening 36*b* of the impeller 36.

Still more particularly, and referring to FIGS. 1 and 11, the shaft-receiving portion 36*b* of the impeller 36 includes a socket-defining projection as at 50 extending from the bottom wall 36*c* of the impeller 36. The first hexagonally shaped region 36*b*′ of the shaft-receiving portion 36*b* is disposed adjacent the blades 36*a* of the impeller 36 and above the socket-defining projection 50 whereas the second hexagonally shaped region 36*b*″ is disposed in the projection 50. Moreover, the socket-defining projection 50 extending from the bottom wall 36*c* of the impeller 36 includes an axially disposed opening 52 adapted to receive a detent 54 on the end 24*b* of the elongated shaft 24 in snap-fit fashion.

As will best be appreciated by referring to FIG. 1, the rapid interconnect means of the riser portion 30 is associated with the upper end 30*a* thereof and the releasable coupling means of the outlet tube 42 is also associated with the upper end 42*a* thereof. The rapid interconnect means and the releasable coupling means (which will be described in detail hereinafter) each are disposed in a common plane at generally the same distance above the volute portion 28. With this arrangement, the motor 22 and the supply tube 44 are adapted to be quickly and easily releasably connected to the disposable pump assembly 20 at a point generally corresponding to the lid of a container of a liquid to be pumped.

Figure 3:
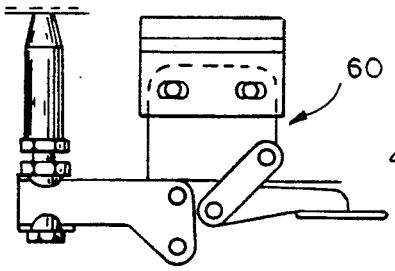
FIG. 3 is a side elevational view of a clamp assembly taken on the line 3—3 of FIG. 2.
Figure 12:
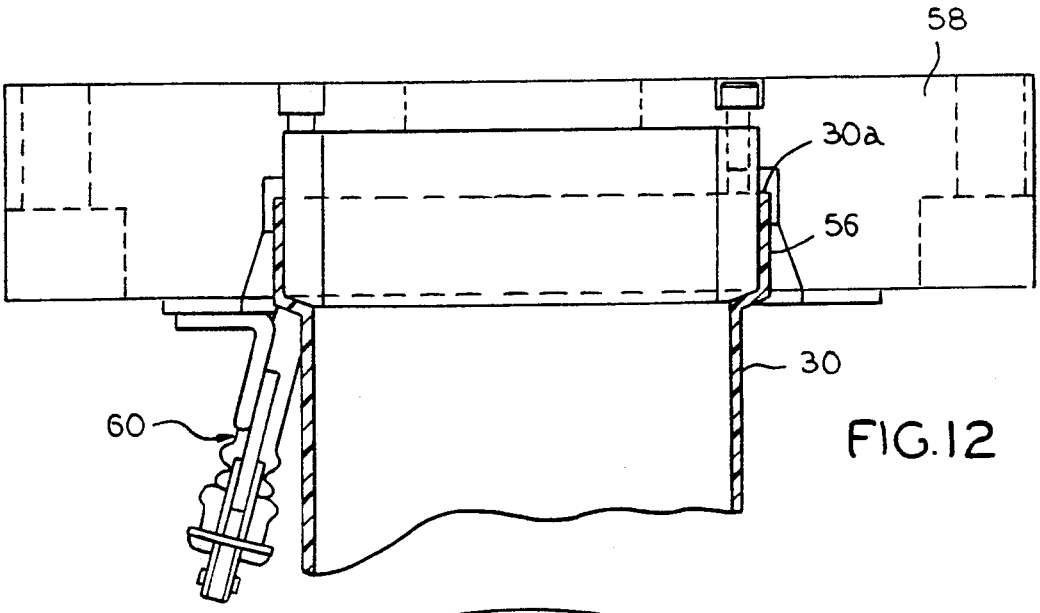
FIG. 12 is a cross-sectional view of a motor-supporting mounting block for the disposable pump assembly of FIG. 1.

Still referring to FIGS. 1 and 2, the rapid interconnect means of the riser portion 30 includes a collar 56 at the upper end 30*a* thereof. It will also be seen that a motor-supporting mounting block 58 is associated with the motor 22 and adapted to fit over the collar 56 of the riser portion 30 (see, also, FIGS. 12 and 13). As best shown in FIGS. 2 and 3, the motor-supporting mounting block 58 further includes at least one clamp assembly 60 adapted to cooperate with the collar 56 (see, in particular, FIG. 2).

As for the releasable securing means of the outlet tube 42, it will be seen to include an externally threaded upper end 42*a*. This externally threaded upper end is adapted to receive an internally threaded coupling 62. As shown, the internally threaded coupling 62 will be provided on the end of the liquid supply tube 44 in conventional fashion.

Figure 8:
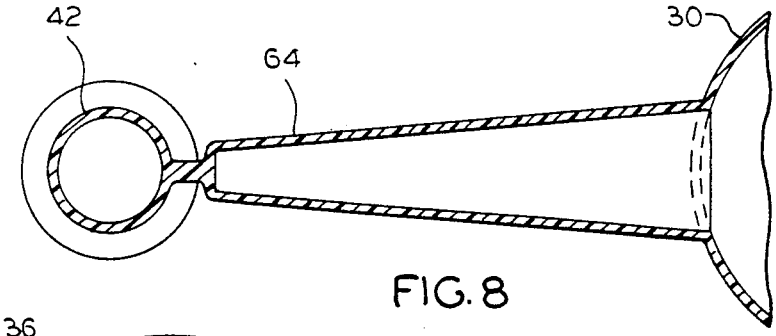
FIG. 8 is a cross-sectional view taken on the line 8—8 of FIG. 1.

As shown in FIGS. 1 and 8, at least one and preferably a pair of support ribs 64 extend between the riser portion 30 and the outlet tube 42 of the pump body 26. The support ribs 64 are positioned generally parallel to and spaced above the volute portion 28 of the pump body 26 with at least one of the ribs 64 in proximity to the upper ends 30*a* and 42*a* of the riser portion 30 and the outlet tube 42, respectively. As will be appreciated, the support ribs 64 are formed of a plastic material so as to be integral with the riser portion 30 and the outlet tube 42 of the pump body 26.

With the arrangement of the present invention, the pump body 26 is adapted to initially be formed of the plastic material by the thermoforming or blow molding process into two generally symmetrical pump body halves 26*a* and 26*b*. Each of the pump body halves 26*a* and 26*b* is matingly engageable with the other of the pump body halves, and with the impeller 36 confined within the volute portion 28, in such a manner as to fully define the volute portion 28, riser portion 30 and outlet tube 42. Furthermore, the pump body 26 finally is completely formed after the thermoforming or blow molding process has been completed by permanently securing the pump body halves 26*a* and 26*b*.

In the preferred embodiment, the volute portion 28 of the pump body 26 includes a separate cap 66 defining the bottom wall 28*a* of the volute portion 28 as best shown in FIG. 1. The cap 66 has a central opening defining the inlet opening 38 and the volute portion 28 further includes a circular cap-retaining flange 28*c* extending thereabout. Moreover, as best shown in FIG. 1, the cap 66 has a circular flange-receiving groove 66*a* adapted to cooperate with the circular cap-retaining flange 28*c* after insertion of the impeller 36 into the volute portion 28.

Referring now to FIGS. 1, 6, 7 and 9, each of the pump body halves such as 26*a* is formed with a flange 68*a* corresponding to a flange 68*b* of the other of the pump body halves such as 26*b*. The corresponding flanges 68*a* and 68*b* of the pump body halves 26*a* and 26*b* extend at least partially about the respective ones of the pump body halves 26*a* and 26*b*. With this arrangement, the corresponding flanges 68*a* and 68*b* thereof can be matingly engaged after which they can be permanently secured together so as to finally form the pump body 26.

Figure 13:
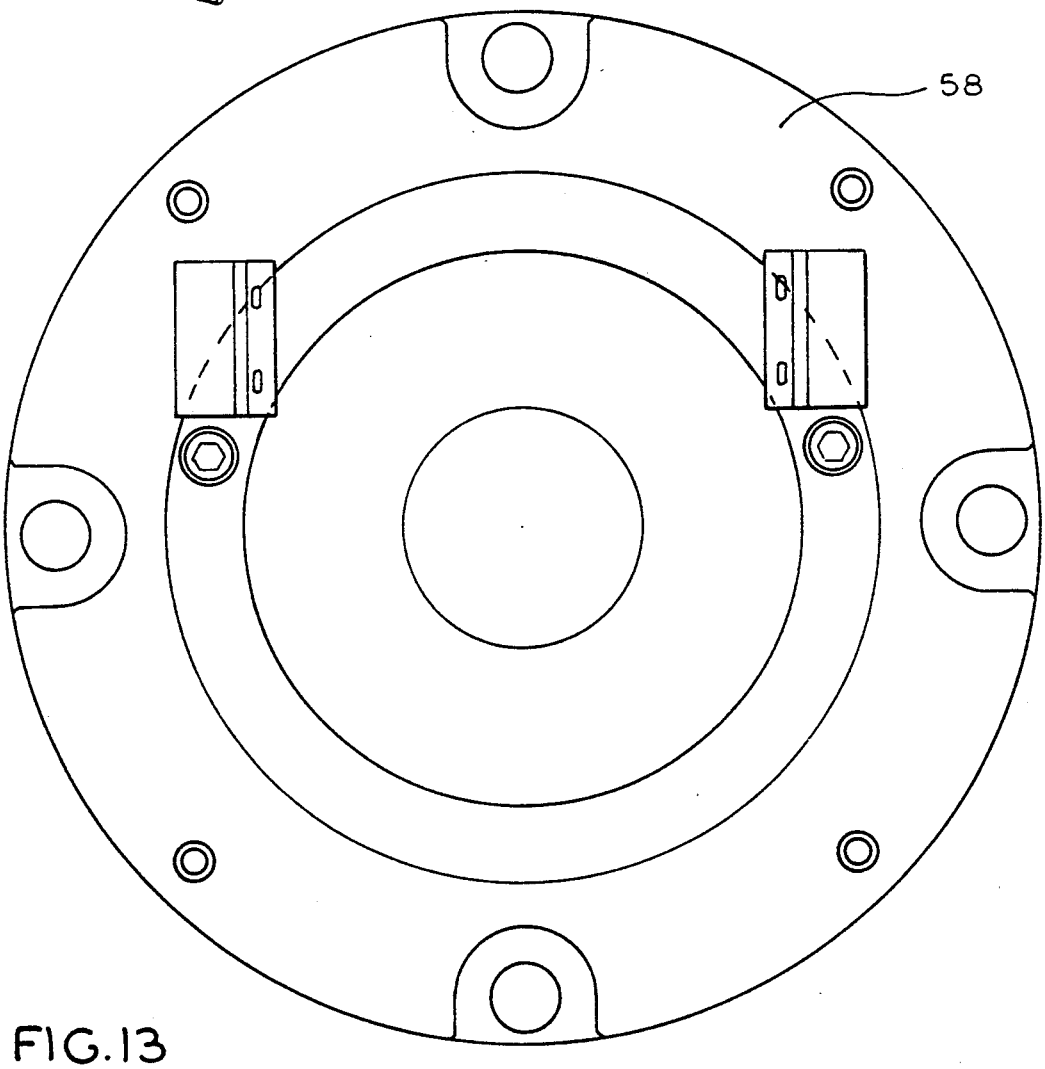
FIG. 13 is a bottom plan view of the motor-supporting mounting block of FIG. 12.

As will be appreciated by referring to FIG. 13, the rapid interconnect means preferably includes a pair of clamp assemblies 60 carried by the mounting block 58.

One of the clamp assemblies 60 is then disposed adjacent the outlet tube 42 with the other of the clamp assemblies being disposed generally diametrically opposite the outlet tube 42. As will be appreciated by referring to FIG. 2, the clamp assemblies 60 each are adapted to cooperate with the collar 56 of the riser portion 30 of the pump body 26.

Preferably, the pump body halves 26*a* and 26*b* are formed of very thin sheets of a material such as polypropylene or polyethylene that are vacuum formed in two different halves to make the shape of the volute portion 28. The two different halves also form the riser portion 30 and the integral outlet tube 42 leading, respectively, to the collar 56 and the threaded end 42*a* which comprises a hose connector. Since the shaft 24 normally remains connected to the motor 22, it is only necessary to insert the shaft 24 into the riser portion 30 until it can be snapped into the formed fitting 50 in the impeller 36 for use of the pump 20.

When it is desired to change to a different color ink, the operator simply disengages the clamp assemblies 60 from the collar 56. It is then a simple matter for the operator to pull the motor 22 away from the pump 20 thereby disengaging the shaft 24 from the impeller fitting 50, i.e., disengaging the detent 54 from the opening 52 in the fitting 50. Once this has been done, only the end of the shaft 24 need be cleaned of ink by wiping before the shaft 24 can be inserted into another pump 20 which can then be placed in a bucket containing a different color of ink for another run.

In this manner, the time consuming and costly changeover of a standard pump is entirely avoided. More specifically, it is no longer necessary to run a solvent through the pump for cleaning and it is also no longer necessary to entirely wipe off the external portions of the pump which have been submerged in ink. Instead, the operator need only wipe off the end of the shaft 24 upon completion of a press run.

As will be appreciated, the double-hexagon shape on the end of the shaft 24 is a unique feature of the invention. This meets with a corresponding double-hexagon shaft-receiving portion of the fitting 50 and the impeller 36. With this construction, there is better drivability of the impeller 36 while the detent 54 retains the connection between the shaft 24 and the impeller 36.

As for the final assembly of the pump 20, the flanges 68*a* and 68*b* can be welded together using a solvent or heat sealed. It may also be advantageous for the flanges to be secured together in any other conventional fashion to render the pump body halves integral. In any event, with the present invention, it is possible to provide a disposable pump assembly that is quite inexpensive.

While in the foregoing there has been set forth a preferred embodiment of the invention, it is to be understood that the invention is only to be limited by the true spirit and scope of the appended claims.

I claim:

1. A disposable pump assembly adapted to be driven by a motor through elongated shaft means, comprising:

a pump body including a volute portion and an elongated riser portion extending upwardly from said volute portion, said riser portion being integrally joined to said volute portion by a neck defining a restricted opening leading from said riser portion to said volute portion, said elongated shaft means being adapted to be inserted into said riser portion, through said restricted opening and into said volute portion of said pump body; and a shaft-receiving impeller disposed in said volute portion of said pump body for driven movement by said motor, said impeller and said elongated shaft means each having corresponding rapid interconnect and drive means adapted for axially releasable mating engagement upon axial insertion of said elongated shaft means through said riser portion and into said volute portion of said pump body, said impeller being adapted for driven movement upon axially releasable mating engagement of said rapid interconnect and drive means;

said rapid interconnect and drive means comprising in part a centrally disposed axial shaft receiving portion of said impeller, said centrally disposed axial shaft received portion including first and second axially spaced regions, at least one of said regions being non-circular in cross-section, said first region being dimensioned larger than said second region, said elongated shaft means including correspondingly sized and shaped first and second regions for insertion into said shaft receiving opening of said impeller;

said volute portion of said pump body having an inlet opening and an outlet opening, and said pump body including an outlet tube extending upwardly from said outlet opening in said volute portion, said outlet tube being disposed in spaced relation to said riser portion;

said riser portion having an upper end remote from said volute portion, said upper end of said riser portion and said motor each having corresponding rapid interconnect means for releasably securing said motor to said riser portion, said outlet tube also having an upper end remote from said volute portion;

said upper end of said outlet tube including means for releasably coupling a supply tube thereto;

said volute portion, riser portion, outlet tube and impeller all being formed of a plastic material.

2. The disposable pump assembly as defined in claim 1 wherein said volute portion and said riser portion are shaped generally cylindrical, said restricted opening defining said neck between said volute portion and said riser portion also being shaped generally cylindrical, said neck having a diameter substantially the same as the diameter of said elongated shaft means to define a bearing surface therefor.

3. The disposable pump assembly as defined in claim 2 wherein said bearing surface defined by said neck forms a partial seal between said volute portion and said riser portion, said partial seal being adapted to limit penetration of a liquid being pumped from a container into said riser portion, said riser portion including at least one opening disposed above said neck for draining said liquid penetrating said partial seal.

4. The disposable pump assembly as defined in claim 1 wherein said inlet opening in said volute portion of said pump body is disposed in a bottom wall thereof, said inlet opening being generally coaxial with said volute portion, riser portion and neck therebetween, said outlet opening in said volute portion of said pump body being disposed radially outwardly of said inlet opening in a side wall thereof.

5. The disposable pump assembly as defined in claim 1 wherein said impeller is generally cup-shaped and has a plurality of blades extending radially therein, said rapid interconnect and drive means comprising in part a centrally disposed axial shaft-receiving portion of said impeller, said shaft-receiving portion and said elongated shaft means having corresponding non-circular cross-sections for driven movement of said impeller by said motor.

6. The disposable pump assembly as defined in claim 5 wherein said shaft-receiving portion of said impeller includes first and second axially spaced hexagonally shaped regions, said first hexagonally shaped region being dimensioned larger than said second hexagonally shaped region, said elongated shaft means including correspondingly sized first and second axially spaced hexagonally spaced regions for insertion into said shaft-receiving opening of said impeller.

7. The disposable pump assembly as defined in claim 1 wherein said rapid interconnect means of said riser portion is associated with said upper end of said riser portion, said releasable coupling means of said outlet tube also being associated with said upper end of said outlet tube, said rapid interconnect means and said releasable coupling means each being disposed in a common plane at generally the same distance above said volute portion.

8. The disposable pump assembly as defined in claim 7 including at least one support rib extending between said riser portion and said outlet tube of said pump body, said support rib being positioned generally parallel to and spaced above said volute portion of said pump body in proximity to said upper ends of said riser portion and said outlet tube, said support rib being formed of said plastic material integrally with said riser portion and said outlet tube of said pump body.

9. A disposable pump assembly adapted to be driven by a motor through elongated shaft means, comprising:

a pump body including a volute portion and an elongated riser portion extending upwardly from said volute portion, said riser portion being integrally joined to said volute portion by a neck defining a restricted opening leading from said riser portion to said volute portion, said elongated shaft means being adapted to be inserted into said riser portion, through said restricted opening and into said volute portion of said pump body; and a shaft-receiving impeller disposed in said volute portion of said pump body for driven movement by said motor, said impeller and said elongated shaft means each having corresponding rapid interconnect and drive means adapted for axially releasable mating engagement upon axial insertion of said elongated shaft means through said riser portion and into said volute portion of said pump body, said impeller being adapted for driven movement upon axially releasable mating engagement of said rapid interconnect and drive means;

said volute portion of said pump body having an inlet opening and an outlet opening, and said pump body including an outlet tube extending upwardly from said outlet opening in said volute portion, said outlet tube being disposed in spaced relation to said riser portion;

said riser portion having an upper end remote from said volute portion, said upper end of said riser portion and said motor each having corresponding rapid interconnect means for releasably securing said motor to said riser portion, said outlet tube also having an upper end remote from said volute portion;

said upper end of said outlet tube including means for releasably coupling a supply tube thereto;

said volute portion, riser portion, outlet tube and impeller all being formed of a plastic material;

said impeller being generally cup shaped and having a plurality of blades extending radially therein;

said rapid interconnect and drive means comprising in part a centrally disposed axial shaft receiving portion of said impeller, said centrally disposed shaft receiving portion including first and second axially spaced hexagonally shaped regions, said first hexagonally shaped region being dimensioned larger than said second hexagonally shaped region, said elongated shaft means including correspondingly sized first and second axially spaced hexagonally shaped regions for insertion into said shaft receiving opening of said impeller;

said shaft-receiving portion further including a socket-defining projection extending from said bottom of said impeller, said first hexagonally shaped region of said shaft-receiving portion being disposed adjacent said blades of said impeller and said second hexagonally shaped region being disposed in said projection, said socket defining projection of said shaft-receiving portion including an axially disposed opening adapted to receive a detent on the end of said elongated shaft means.

10. A disposable pump assembly adapted to be driven by a motor through elongated shaft means, comprising:

a pump body including a volute portion and an elongated riser portion extending upwardly from said volute portion, said riser portion being integrally joined to said volute portion by a neck defining a restricted opening leading from said riser portion to said volute portion, said elongated shaft means being adapted to be inserted into said riser portion, through said restricted opening and into said volute portion of said pump body; and a shaft-receiving impeller disposed in said volute portion of said pump body for driven movement by said motor, said impeller and said elongated shaft means each having corresponding rapid interconnect and drive means adapted for axially releasable mating engagement upon axial insertion of said elongated shaft means through said riser portion and into said volute portion of said pump body, said impeller being adapted for driven movement upon axially releasable mating engagement of said rapid interconnect and drive means;

said volute portion of said pump body having an inlet opening and an outlet opening, and said pump body including an outlet tube extending upwardly from said outlet opening in said volute portion, said outlet tube being disposed in spaced relation to said riser portion;

said riser portion having an upper end remote from said volute portion, said upper end of said riser portion and said motor each having corresponding rapid interconnect means for releasably securing said motor to said riser portion, said outlet tube also having an upper end remote from said volute portion;

said upper end of said outlet tube including means for releasably coupling a supply tube thereto;

said volute portion, riser portion, outlet tube and impeller all being formed of a plastic material;

said rapid interconnect means of said riser portion being associated with said upper end of said rise portion, said releasable coupling means of said outlet to also being associated with said upper end of said outlet tube, said rapid interconnect means and said releasable coupling means each being disposed in a common plane of generally the same distance above said volute portion;

said rapid interconnect means of said riser portion including a collar at said upper end thereof, and including a motor-supporting mounting block associated with said motor and adapted to fit over said collar of said riser portion, said motor-supporting mounting block further including at least one clamp assembly adapted to cooperate with said collar; and said releasable securing means of said outlet tube including an externally threaded upper end thereof adapted to receive an internally threaded coupling of a liquid supply tube.

11. A disposable pump assembly adapted to be driven by a motor through an elongated shaft, said pump assembly being formed of a plastic material at least in part by a blow molding process, said disposable pump assembly comprising:

a pump body including a volute portion and an elongated riser portion extending upwardly from said volute portion, said riser portion being integrally joined to said volute portion by a neck defining a restricted opening leading from said riser portion of said volute portion, said elongated shaft being adapted to be inserted into said riser portion, through said restricted opening and into said volute portion of said pump body; and a shaft-receiving impeller disposed in said volute portion of said pump body for driven movement by said motor, said impeller and said elongated shaft each having corresponding rapid interconnect and drive means adapted for axially releasable mating engagement upon axial insertion of said elongated shaft through said riser portion and into said volute portion of said pump body, said impeller being adapted for driven movement upon axially releasable mating engagement of said rapid interconnect and drive means;

said rapid interconnect and drive mans comprising in part a centrally disposed axial shaft receiving portion of said impeller, said centrally disposed axial shaft receiving portion including first and second axially spaced regions, at least one of said regions being non-circular in cross-section, said first region being dimensioned larger than said second region, said elongated shaft means including correspondingly sized and shaped first and second regions for insertion into said shaft receiving opening of said impeller;

said volute portion of said pump body having an inlet opening and an outlet opening, and said pump body including an outlet tube extending upwardly form said outlet opening in said volute portion, said outlet tube being disposed in spaced parallel relation to said riser portion;

said riser portion having an upper end remote from said volute portion, said upper end of said riser portion and said motor each having corresponding rapid interconnect means for releasably securing said motor to said riser portion, said outlet tube also having an upper end remote from said volute portion;

said upper end of said outlet tube including means for releasably coupling a supply tube thereto;

said pump body initially being formed of said plastic material by said blow molding process into two generally symmetrical pump body halves;

each of said pump body halves being matingly engagable with the other of said pump body halves, and with said impeller in said volute portion, in such a manner as to fully define said volute portion, riser portion and outlet tube;

said pump body finally being formed after completing said blow molding process by permanently securing said pump body halves.

12. The disposable pump assembly as defined in claim 11 wherein said volute portion and said riser portion are shaped generally cylindrical, said restricted opening defining said neck between said volute portion and said riser portion also being shaped generally cylindrical, said neck having a diameter substantially the same as the diameter of said elongated shaft to define a bearing surface therefor.

13. The disposable pump assembly as defined in claim 12 wherein said bearing surface defined by said neck forms a partial seal between said volute portion and said riser portion, said partial seal being adapted to limit penetration of a liquid being pumped from a container into said riser portion, said riser portion including at least one opening disposed above said neck for draining said liquid penetrating said partial seal.

14. The disposable pump assembly as defined in claim 11 wherein said inlet opening in said volute portion of said pump body is disposed in a bottom wall thereof, said inlet opening being generally coaxial with said volute portion, riser portion and neck therebetween, said outlet opening in said volute portion of said pump body being disposed radially outwardly of said inlet opening in a side wall thereof.

15. The disposable pump assembly as defined in claim 14 wherein said volute portion of said pump body includes a separate cap defining said bottom wall thereof, said cap having a central opening defining said inlet opening and said volute portion including a circular cap-retaining flange extending thereabout, said cap having a circular flange-receiving groove adapted to cooperate with said circular cap-retaining flange after insertion of said impeller into said volute portion.

16. The disposable pump assembly as defined in claim 11 wherein each of said pump body halves is formed with a flange corresponding to a flange of the other of said pump body halves, said corresponding flanges of said pump body halves extending at least partially about the respective ones of said pump body halves, each of said pump body halves being such that corresponding flanges of said pump body halves are matingly engaged after which said corresponding flanges are permanently secured to finally form said pump body.

17. The disposable pump assembly as defined in claim 11 wherein said rapid interconnect means of said riser portion is associated with said upper end of said riser portion, said releasable coupling means of said outlet tube also being associated with said upper end of said outlet tube, said rapid interconnect means and said releasable coupling means each being disposed in a common plane at generally the same distance above said volute portion.

18. The disposable pump assembly as defined in claim 17 including a pair of support ribs extending between said riser portion and said outlet tube of said pump body, said support ribs being positioned generally parallel to and spaced above said volute portion of said pump body and one another with one of said support ribs in proximity to said upper ends of said riser portion and said outlet tube, said support ribs being formed of said plastic material integrally with said riser portion and said outlet tube of said pump body.

19. The disposable pump assembly as defined in claim 17 wherein said rapid interconnect means of said riser portion includes a collar at said upper end thereof, and including a motor-supporting mounting block associated with said motor and adapted to fit over said collar of said riser portion, said motor-supporting mounting block further including at least one clamp assembly adapted to cooperate with said collar, said releasable securing means of said outlet tube including an externally threaded upper end thereof adapted to receive an internally threaded coupling of a liquid supply tube.

20. The disposable pump assembly as defined in claim 19 wherein said rapid interconnect means includes a pair of clamp assemblies carried by said mounting block, one of said clamp assemblies being disposed adjacent said outlet tube and the other of said clamp assemblies being disposed generally diametrically opposite said outlet tube, said clamp assemblies each being adapted to cooperate with said collar of said riser portion of said pump body.

21. A disposable pump assembly adapted to be driven by a motor through an elongated shaft, said pump assembly being formed of a plastic material at least in part by a thermoforming process as an entirely self-containing unit, said disposable pump assembly comprising:

a pump body including a volute portion and an elongated riser portion extending upwardly form said volute portion, said riser portion being integrally joined to said volute portion by a neck defining a restricted opening leading from said riser portion to said volute portion, said elongated shaft being adapted to be inserted into said riser portion, through said restricted opening and into said volute portion of said pump body;

said volute portion and said riser portion of said pump body each being shaped so as to be generally cylindrical in cross-section, said restricted opening defining said neck between said volute portion and said riser portion also being shaped generally cylindrical in cross-section said neck having an inner surface adapted to serve as a bearing surface for said elongated shaft when said elongated shaft is driven by said motor; and a shaft-receiving impeller confined within said volute portion of said pump body for driven movement by said motor, said impeller and said elongated shaft each having corresponding rapid interconnect and drive means adapted for axially releasable mating engagement upon axial insertion of said elongated shaft through said riser portion and into said volute portion of said pump body, said impeller being adapted for driven movement upon axially releasable mating engagement of said rapid interconnect and drive means;

said rapid interconnect and drive means comprising in part a centrally disposed axial shaft receiving portion of said impeller, said centrally disposed shaft receiving portion including first and second axially spaced regions, at least one of said regions being non-circular in cross-section, said first region being dimensioned larger than said second region, said elongated shaft means including correspondingly sized and shaped first and second regions for insertion into said shaft receiving opening of said impeller;

said volute portion of said pump body having an inlet opening and an outlet opening, and said pump body including an outlet tube extending upwardly from said outlet opening in said volute portion, said outlet tube being disposed in spaced parallel relation to said riser portion;

said riser portion having an upper end remote from said volute portion, said upper end of said riser portion and said motor each having corresponding rapid interconnect means for releasably securing said motor to said riser portion, said outlet tube also having an upper end remote from said volute portion;

said upper end of said outlet tube including means for releasably coupling a supply tube thereto;

said pump body initially being formed of said plastic material by said thermoforming process into two generally symmetrical pump body halves;

each of said pump body halves having a flange corresponding to a flange of the other of said pump body halves, said corresponding flanges of said pump body halves extending at least partially about the respective ones of said pump body halves, each of said pump body halves having corresponding flanges matingly engaged and permanently secured to finally form said pump body.

22. The disposable pump assembly as defined in claim 21 wherein said impeller is generally cup-shaped and has a plurality of blades extending radially therein, said rapid interconnect and drive means comprising in part a centrally disposed axial shaft-receiving portion of said impeller, said shaft-receiving portion and said elongated shaft means having corresponding non-circular cross-sections for driven movement of said impeller by said motor.

23. The disposable pump assembly as defined in claim 22 wherein said shaft-receiving portion of said impeller includes first and second axially spaced hexagonally shaped regions, said first hexagonally shaped region being dimensioned larger than said second hexagonally shaped region, said elongated shaft means including correspondingly sized first and second axially shaped hexagonally shaped regions for insertion into said shaft-receiving opening of said impeller.

24. A disposable pump assembly adapted to be driven by a motor through an elongated shaft, said pump assembly being formed of a plastic material at least in part by a thermoforming process as an entirely self-contained unit, said disposable pump assembly comprising:

a pump body including a volute portion and an elongated riser portion extending upwardly from said volute portion, said riser portion being integrally joined to said volute portion by a neck defining a restricted opening leading from said riser portion to said volute portion, said elongated shaft being adapted to be inserted into said riser portion, through said restricted opening and into said volute portion of said pump body;

said volute portion and said riser portion of said pump body each being shaped so as to be generally cylindrical in cross-section, said restricted opening defining said neck between said volute portion and said riser portion also being shaped generally cylindrical in cross-section, said neck having an inner surface adapted to serve as a bearing surface for said elongated shaft when said elongated shaft is driven by said motor; and a shaft-receiving impeller confined within said volute portion of said pump body for driven movement by said motor, said impeller and said elongated shaft each having corresponding rapid interconnect and drive means adapted for axially releasable mating engagement upon axial insertion of said elongated shaft through said riser portion and into said volute portion of said pump body, said impeller being adapted for driven movement upon axially releasable mating engagement of said rapid interconnect and drive means;

said volute portion of said pump body having an inlet opening and an outlet opening, and said pump body including an outlet tube extending upwardly from said outlet opening in said volute portion, said outlet tube being disposed in spaced parallel relation to said riser portion;

said riser portion having an upper end remote from said volute portion, said upper end of said riser portion and said motor each having corresponding rapid interconnect means for releasably securing said motor to said riser portion, said outlet tube also having an upper end remote from said volute portion;

said upper end of said outlet tube including means for releasably coupling a supply tube thereto;

said pump body initially being formed of said plastic material by said thermoforming process into two generally symmetrical pump body halves;

each of said pump body halves having a flange corresponding to a flange of the other of said pump body halves, said corresponding flanges of said pump body halves extending at least partially about the respective ones of said pump body halves, each of said pump body halves having corresponding flanges matingly engaged and permanently secured to finally form said pump body;

said impeller being generally cup-shaped and having a plurality of blades extending radially therein;

said rapid interconnect and drive means comprising in part a centrally disposed axial shaft-receiving portion of said impeller including first and second axially spaced hexagonally shaped regions, said first hexagonally shaped region being dimensioned larger than said second hexagonally shaped region, said elongated shaft means including correspondingly sized first and second axially spaced horizontal shaped regions for insertion into said shaft-receiving opening of said impeller;

said shaft receiving portion further including a socket-defining projection extending from said bottom of said impeller, said first hexagonally shaped region of said shaft-receiving portion being disposed adjacent said blades of said impeller and said second hexagonally shaped region being disposed in said projection, said socket-defining projection of said shaft-receiving portion including an axially disposed opening adapted to receive a detent on the end of said elongated shaft means.

25. A disposable pump assembly adapted to be driven by a motor through an elongated shaft, said pump assembly being formed of a plastic material at least in part by a thermoforming process as an entirely self-contained unit, said disposable pump assembly comprising:

a pump body including a volute portion and an elongated riser portion extending upwardly from said volute portion, said riser portion being integrally joined to said volute portion by a neck defining a restricted opening leading from said riser portion to said volute portion, said elongated shaft being adapted to be inserted into said riser portion, through said restricted opening and into said volute portion of said pump body;

said volute portion and said riser portion of said pump body each being shaped so as to be generally cylindrical in cross-section, said restricted opening defining said neck between said volute portion and said riser portion also being shaped generally cylindrical in cross-section, said neck having an inner surface adapted to serve as a bearing surface for said elongated shaft when said elongated shaft is driven by said motor; and a shaft-receiving impeller confined within said volute portion of said pump body for driven movement by said motor, said impeller and said elongated shaft each having corresponding rapid interconnect and drive means adapted for axially releasable mating engagement upon axial insertion of said elongated shaft through said riser portion and into said volute portion of said pump body, said impeller being adapted for driven movement upon axially releasable mating engagement of said rapid interconnect and drive means;

said volute portion of said pump body having an inlet opening ana an outlet openings, and said pump body including an outlet tube extending upwardly from said outlet opening in said volute portion, said outlet tube being disposed in spaced parallel relation to said riser portion;

said riser portion having an upper end remote from said volute portions, said upper end of said riser portion and said motor each having corresponding rapid interconnect means for releasably securing said motor to said riser portion, said outlet tube also having an upper end remote from said volute portion;

said upper end of said outlet tube including means for releasably coupling a supply tube thereto;

said pump body initially being formed of said plastic material by said thermoforming process into two generally symmetrical pump body halves;

each of said pump body halves having a flange corresponding to a flange of the other of said pump body halves, said corresponding flanges of said pump body halves extending at least partially about the respective ones of said pump body halves, each of said pump body halves having corresponding flanges matingly engaged and permanently secured to finally form said pump body;

said impeller being generally cup-shaped and having a plurality of blades extending radially therein;

said rapid interconnect and drive means comprising in part a centrally disposed axial shaft-receiving portion of said impeller including first and second axially spaced hexagonally shaped regions, said first hexagonally shaped region being dimensioned larger than said second hexagonally shaped region, said elongated shaft means including correspondingly sized first and second axially shaped horizontal shaped regions for insertion into said shaft-receiving opening of said impeller;

said shaft receiving portion further including a socket-defining projection extending form said bottom of said impeller, said first hexagonally shaped region of said shaft-receiving portion being disposed adjacent said blades of said impeller and said second hexagonally shaped region being disposed in said projection, said socket-defining projection of said shaft-receiving portion including an axially disposed opening adapted to receive a detent on the end of said elongated shaft means; and said inlet opening in said volute portion of said pump body being disposed in a bottom wall thereof, said inlet opening being generally coaxial with said volute portion, riser portion and neck therebetween, said outlet opening in said volute portion of said pump body being disposed radially outwardly of said inlet opening in a side wall thereof.

* * * * *